US009267085B2

(12) United States Patent
Wang et al.

(10) Patent No.: US 9,267,085 B2
(45) Date of Patent: Feb. 23, 2016

(54) SYSTEMS AND METHODS FOR PROCESSING SOLID POWDERS

(75) Inventors: Mingmin Wang, Shanghai (CN); Lishun Hu, Shanghai (CN); Gang Liu, Shanghai (CN); Ke Liu, Irvine, CA (US); Zhe Cui, Irvine, CA (US); Wei Chen, Shanghai (CN); Jing Lv, Shanghai (CN); Tong Zhao, Shanghai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 988 days.

(21) Appl. No.: 13/293,577

(22) Filed: Nov. 10, 2011

(65) Prior Publication Data

US 2012/0117874 A1 May 17, 2012

(30) Foreign Application Priority Data

Nov. 2, 2010 (CN) ..... 2010 1 0538173

(51) Int. Cl.

| | |
|---|---|
| ***B01J 19/00*** | (2006.01) |
| ***B67D 7/58*** | (2010.01) |
| ***B01J 7/00*** | (2006.01) |
| ***C10J 3/48*** | (2006.01) |
| ***C10J 3/50*** | (2006.01) |

(52) U.S. Cl.

CPC *C10J 3/485* (2013.01); *C10J 3/506* (2013.01); *C10J 2300/0906* (2013.01); *C10J 2300/0909* (2013.01); *C10J 2300/1693* (2013.01); *C10J 2300/1884* (2013.01)

(58) Field of Classification Search

USPC ..... 48/127.1, 127.9, 76, 77, 101, 199 R, 48/203, 207, 210, DIG. 4, 61

See application file for complete search history.

(56) References Cited

U.S. PATENT DOCUMENTS

| | | | |
|---|---|---|---|
| 2,704,704 | A | 3/1955 | Ocorzaly |
| 4,044,904 | A | 8/1977 | Trumbull et al. |
| 4,207,081 | A | 6/1980 | Preusser et al. |
| 4,312,638 | A | 1/1982 | Koump |
| 5,456,066 | A | 10/1995 | Smith et al. |
| 5,560,550 | A | 10/1996 | Krawczyk |

(Continued)

FOREIGN PATENT DOCUMENTS

| | | | |
|---|---|---|---|
| CN | 1367229 | A | 9/2002 |
| CN | 101481631 | A | 7/2009 |

(Continued)

OTHER PUBLICATIONS

Office Action dated Jul. 15, 2013 from corresponding CN Application No. 201010538173.0.

Unofficial English Translation of Japanese Office Action issued in connection with corresponding JP Application No. 2011242972 on Sep. 29, 2015.

*Primary Examiner* — Kaity Handal

(74) *Attorney, Agent, or Firm* — GE Global Patent Operation; Peter T. DiMauro

(57) ABSTRACT

A system for gasification of a solid powder is provided. The system comprises one or more conveying tanks configured to receive a solid powder and one or more solid pumps disposed downstream of and in fluid communication with the one or more respective conveying tanks. The system further comprises a gasifier disposed downstream of and in fluid communication with the one or more solid pumps. A conveyance unit and a method for conveyance and gasification of a solid powder are also presented.

14 Claims, 6 Drawing Sheets

(56) References Cited

U.S. PATENT DOCUMENTS

| | | | |
|---|---|---|---|
| 2009/0107046 | A1 | 4/2009 | Leininger et al. |
| 2009/0178336 | A1 | 7/2009 | Van Der Ploeg |
| 2009/0178338 | A1 | 7/2009 | Leininger et al. |

FOREIGN PATENT DOCUMENTS

| | | | |
|---|---|---|---|
| JP | 53105503 | A | 9/1978 |
| JP | 62285990 | A | 12/1987 |
| JP | 11152481 | A | 6/1999 |
| WO | 2011041024 | A1 | 4/2011 |
| WO | 2011041032 | A2 | 4/2011 |

SYSTEMS AND METHODS FOR PROCESSING SOLID POWDERS

BACKGROUND

Embodiments of the invention generally relate to systems and methods for processing solid powders. More particularly, embodiments of the invention relate to systems and methods for conveyance and gasification of solid powders such as solid carbonaceous fuel powders.

Gasification is a process that enables the conversion of carbonaceous fuels, such as coal into a combustible gas, such as coal gas or synthesis gas. Generally, gasification processes include conveying carbonaceous fuels into gasifiers along with a controlled and/or limited amount of oxygen and other steams. A stable and controllable flow of such carbonaceous fuels into gasifiers is beneficial for obtaining desirable gasification performance.

In conventional gasification systems, pneumatic conveyance technologies are usually employed to convey carbonaceous fuels into gasifiers. Such gasification systems comprise storage tanks, gasifiers and a plurality of pipelines in fluid communication with respective tanks and gasifiers. The storage tanks receive carbonaceous fuels and carrier gases through the pipelines. With the introduction of the carrier gases into the storage tanks, the pressures of the storage tanks increase to desired levels, which are higher than pressures in the gasifiers so as to generate pressure differences between such storage tanks and gasifiers. A solid-gas mixture then may be conveyed from the storage tanks into the gasifiers.

However, in such conventional gasification systems, the flow of the carbonaceous fuels into the storage tanks may be not uniform. As a result, the conveyance of the carbonaceous fuels into the gasifier may thus become unstable. This may generate temperature fluctuations in the gasifiers, which fluctuations are disadvantageous to the performance and service life of the gasifiers. Further, when such conventional gasification systems convey the carbonaceous fuels such as coal having higher moisture content, the carbonaceous fuels need to be dried to have a relative lower moisture level to avoid blockage of the conveyance into the gasifiers through the storage tanks. This drying process consumes more energy and increases the overall cost for the gasification process.

Therefore, there is a need for new and improved systems and methods for conveyance and gasification of solid powders.

BRIEF DESCRIPTION

A system for gasification of a solid powder is provided in accordance with one embodiment of the invention. The system comprises one or more conveying tanks configured to receive a solid powder and one or more solid pumps disposed downstream of and in fluid communication with the one or more respective conveying tanks. The system further comprises a gasifier disposed downstream of and in fluid communication with the one or more solid pumps.

A conveyance unit for conveying a solid powder for gasification is provided in accordance with another embodiment of the invention. The conveyance unit comprises one or more conveying tanks configured to receive a solid powder; and one or more solid pumps disposed downstream of the one or more respective conveying tanks and configured to pressurize and convey the solid powder from the one or more respective conveying tanks for gasification.

An embodiment further provides a method for gasification of a solid powder. The method comprises introducing a solid powder into one or more conveying tanks; introducing the solid powder from the one or more conveying tanks into one or more respective solid pumps; and pressurizing and conveying the solid powder into a gasifier in virtue of the one or more solid pumps. Wherein the one or more solid pumps are disposed downstream of the one or more respective conveying tanks.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION OF THE DISCLOSURE

Embodiments of the present disclosure will be described hereinbelow with reference to the accompanying drawings. In the following description, well-known functions or constructions are not described in detail to avoid obscuring the disclosure in unnecessary detail.

Figure 1:
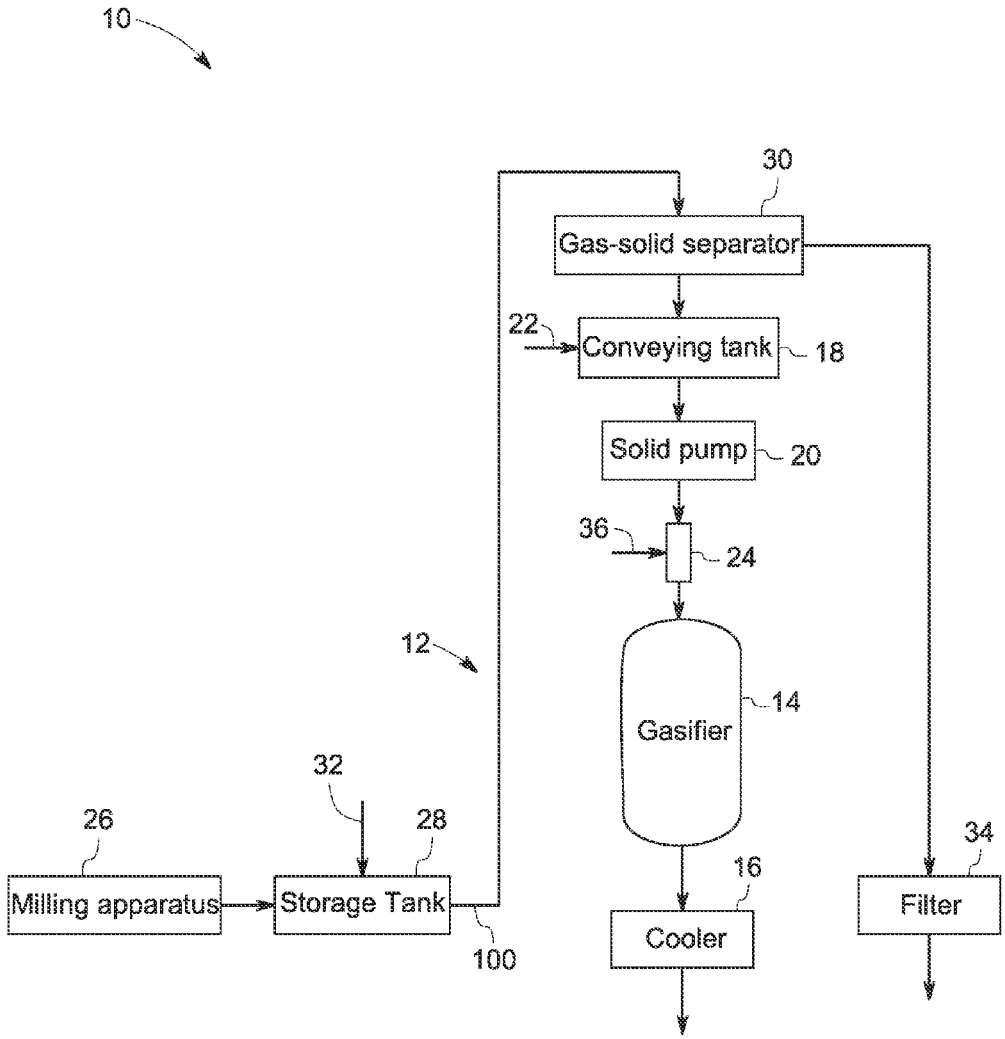
FIG. 1 is schematic diagrams of a gasification system in accordance with one embodiment of the invention.

FIG. 1 illustrates a schematic diagram of a gasification system 10 in accordance with one embodiment of the invention. In embodiments of the invention, the gasification system 10 is configured to gasify a solid powder such as carbonaceous fuels to produce a combustible gas, such as a synthesis gas. Non-limiting examples of the carbonaceous fuels include coal, bituminous, soot, biomass, petroleum coke or combinations thereof.

As illustrated in FIG. 1, the gasification system 10 comprises a conveyance unit 12, a gasifier 14 and a cooler 16. In some embodiments, the conveyance unit 12 may be configured to convey a solid powder 100 with desired size distribution and desired moisture levels into the gasifier 14. The gasifier 14 is disposed downstream of and in fluid communication with the conveyance unit 12 to receive and gasify the solid powder 100. In non-limiting examples, the gasifier 14 may comprise a reactor and have a cylindrical shape with substantially conical or convex upper and lower ends (not labeled). In one example, the gasifier 14 comprises an entrained flow gasifier.

The cooler 16 is in fluid communication with the lower end (not labeled) of the gasifier 14 to receive and cool outputs, such as slag and/or syngas from the gasifier 14. In non-limiting examples, the cooler 16 may have a cylindrical shape and may include a radiation syngas cooler (RSC) or a cooler with a slag bath (quench chamber), for example.

In the illustrated example, the gasifier 14 and the cooler 16 are separated units, and in other examples, the gasifier 14 and the cooler 16 may be integrated into a unitary structure. In certain applications, the cooler 16 may not be employed and the syngas from the gasifier 14 may be introduced into a next reactor (not shown), such as a fixed-bed reactor, for further treatment.

For the illustrated arrangement, the conveyance unit 12 comprises a conveying tank 18 and a solid pump 20. The conveying tank 18 receives and conveys the solid powder 100 into the solid pump 20. In some applications, the conveying tank 18 may be operated under a pressure around a normal pressure and a conveyance such as a gas 22 may be introduced into the conveying tank 18 to facilitate the conveyance of the solid powder 100 into the solid pump 20. In some examples, the pressure in the conveying tank 18 may be in a range of 1-2 Mega Pascals (Mpa).

The solid pump 20 is disposed downstream of and in fluid communication with the conveying tank 18. The solid pump 20 pressurizes the solid powder 100 from the conveying tank 18 into the gasifier 14 for gasification. In some embodiments, the solid pump 20 may transport the solid powder 100 from a lower pressure such as an atmospheric pressure to a higher pressure such as a pressure over 1000 psig with a linear relationship between the rotational speed of the solid pump 20 and the solid mass flow. In some examples, the solid pump 20 may also have the capacity for measurement of flow rates of the solid powder 100. In one example, the solid pump 20 comprises a rotary, converging space Solids Transport and Metering pump known as a Stamet™ solid pump commercially available from GE Energy, Atlanta, Ga.

As depicted in FIG. 1, the conveying tank 18 is located above the solid pump 20 and the solid pump 20 is located above the gasifier 14, which may indicate an outlet (not labeled) of the conveying tank 18 may be located above an inlet (not labeled) of the solid pump 20 for the conveyance of the solid powder 100 from the outlet of the conveying tank 18 to the inlet of the solid pump 20, and an outlet (not labeled) of the solid pump 20 may be located above an inlet (not labeled) of the gasifier 14 for the conveyance of the solid powder 100 from the outlet of the solid pump 20 to the inlet of the gasifier 14 for gasification. In other examples, an inlet of the conveying tank 18 may be located above the inlet of the solid pump 20, and the inlet of the solid pump 20 may be located above the inlet of the gasifier 14.

In such a configuration, the solid powder 100 from the solid pump 20 may be introduced into the gasifier 14 with consumption of less energy. In certain applications, the conveying tank 18 may be located below the solid pump 20 and/or the gasifier 14. In the illustrated example, the solid pump 20 is directly connected to the conveying tank 18. In other non-limiting examples, other elements, such as at least one valve (not shown) may be disposed between the solid pump 20 and the conveying tank 18.

Figure 2:
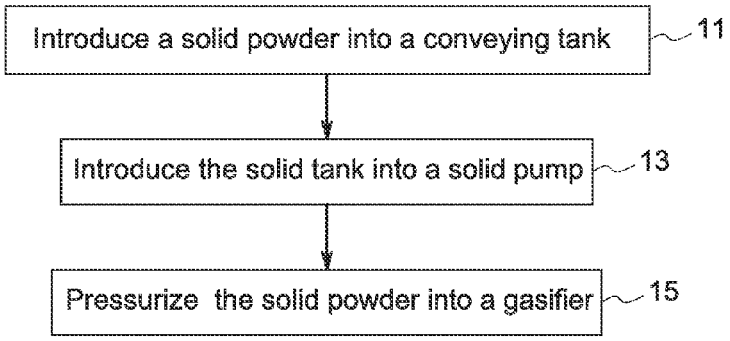
FIG. 2 is a schematic flow chart of a gasification process in the gasification system in accordance with one embodiment of the invention.

Thus, as show in FIG. 2, during operation, in step 11, the solid powder 100 is introduced into the conveying tank 18. In step 13, the solid powder 100 is conveyed into the solid pump 20 from the conveying tank 18. In step 15, the solid powder 100 is pressurized into the gasifier for gasification from the solid pump 20.

For the illustrated arrangement in FIG. 1, the conveyance unit 12 further comprises a feeding apparatus 24 disposed between the solid pump 20 and the gasifier 14. The feeding apparatus 24 is located above the gasifier 14 for facilitating the conveyance of the solid powder 100 from the solid pump 20 into the gasifier 14, so that the solid powder 100 may be introduced into the gasifier 14 more uniformly and stably, and the blockage of the solid powder 100 at an outlet (not labeled) of the solid pump 20 may be avoided.

In some examples, the feeding apparatus 24 is not limited to any specific feeder for feeding the solid powder 100 from the solid pump 20 into the gasifier 14 having a higher pressure. In one example, the feeding apparatus 24 comprises a venturi feeder. In other examples, the feeding apparatus 24 may comprise other configurations including, but not limited to a screw feeder or a conical pipeline with at least an inlet for input of an injected gas (not shown). In non-limiting examples, during operation, a gas 36 may be introduced into the feeding apparatus 24 for conveyance of the solid powder 100 into the gasifier 14. In certain applications, the feeding apparatus and/or the gas 36 may not be employed.

In some applications, the conveying tank 18 may receive the solid powder 100 through one or more conveyance apparatuses. As illustrated in FIG. 1, the conveyance unit 12 further comprises a milling apparatus 26, a storage tank 28 and a gas-solid separator 30 together for conveying the solid powder 100 with desired size distribution and desired moisture levels into the conveying tank 18.

For some arrangements, the milling apparatus 26 is configured to mill a solid material (not shown) into the solid powder 100 and to transport the solid power 100 into the storage tank 28. The storage tank 28 is located between and in fluid communication with the milling apparatus 26 and the gas-solid separator 30 to receive the solid powder from the milling apparatus 26. A gas 32 may be introduced into the storage tank 28 for pneumatic conveyance of the solid powder 100 into the gas-solid separator 30. Non-limiting examples of the gases 22, 32 may include carbon dioxide or an inert gas such as nitrogen, or other suitable gases.

The gas-solid separator 30 is configured to separate at least a portion of the gas 32 from the solid powder 100. The gas 32 from the gas-solid separator 30 is discharged after passing through a filter 34. The separated solid powder 100 is introduced into the conveying tank 18. In the illustrated example, the gas-solid separator 30 comprises a cyclone separator and is located above the conveying tank 18. In other examples, the gas-solid separator 30 may be located below the conveying tank 18 and/or the solid pump 20.

Accordingly, during operation, the solid materials are introduced into the milling apparatus 26 for producing the solid powder 100 with desired size distribution. Then, the solid powder 100 is introduced into the storage tank 28 to form a gas-solid mixture. The gas-solid mixture is introduced into the gas-solid separator 30 so that the solid powder 100 is separated and conveyed into the conveying tank 18.

It should be noted that the arrangement in FIG. 1 is merely illustrative. Although a single solid pump, a single conveying tank, a single feeding apparatus, and a single gas-solid separator are illustrated, more than one solid pump, more than one conveying tank, more than one feeding apparatus and/or more than one gas-solid separator may be employed based on different applications.

In certain applications, the milling apparatus 26, the storage tank 28 and/or the gas-solid separator 30 may not be employed. Other suitable conveyance apparatuses may be employed for conveying the solid powder 100 into the conveying tank 18. Non-limiting examples of other conveyance apparatuses include a conveyor belt, a pump and a screw feeder. Additionally, the separated gas 32 from the filter 34 may be circulated into the storage tank 28 for the pneumatic conveyance of the solid powder 100 into the gas-solid separator 30.

Figure 3:
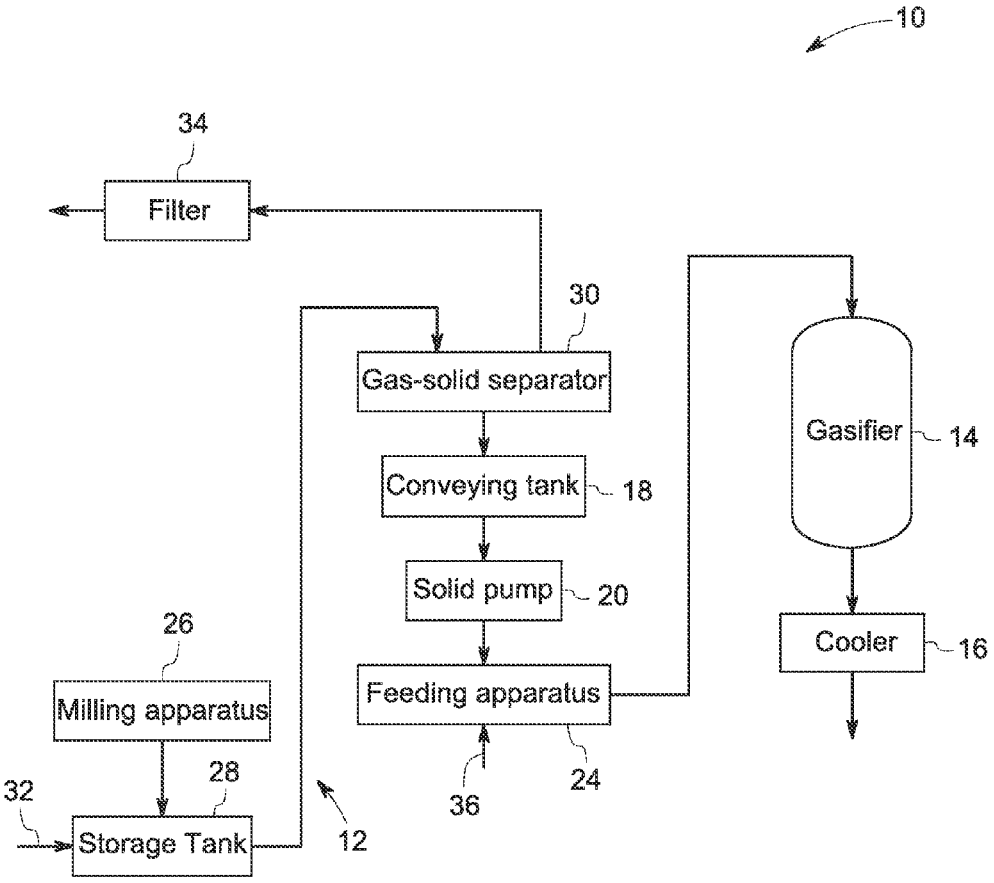
FIGS. 3-7 are schematic diagrams of the gasification system in accordance with various embodiments of the invention.

FIG. 3 illustrates a schematic diagram of the gasification system 10 in accordance with another embodiment of the invention. The arrangement in FIG. 3 is similar to the arrangement in FIG. 1. The two arrangements in FIGS. 1 and 3 differ in that in FIG. 3, the solid pump 20 and the feeding apparatus 24 are disposed below the gasifier 14. In other applications, the feeding apparatus 24 may be located above the gasifier 14.

Thus, during operation, the solid pump 20 pressurizes the solid powder 100 towards the gasifier 14. The feeding apparatus 24 feeds the solid powder 100 into the gasifier 14. The pressure at the outlet of the solid pump 20 may be determined according to the pressure in the feeding apparatus 24. In non-limiting examples, the pressure in the feeding apparatus 24 may be higher than the pressure in the gasifier 14 so as to lift the solid powder 100 into the gasifier 14 and offset the pressure drop during conveyance.

Figure 4:
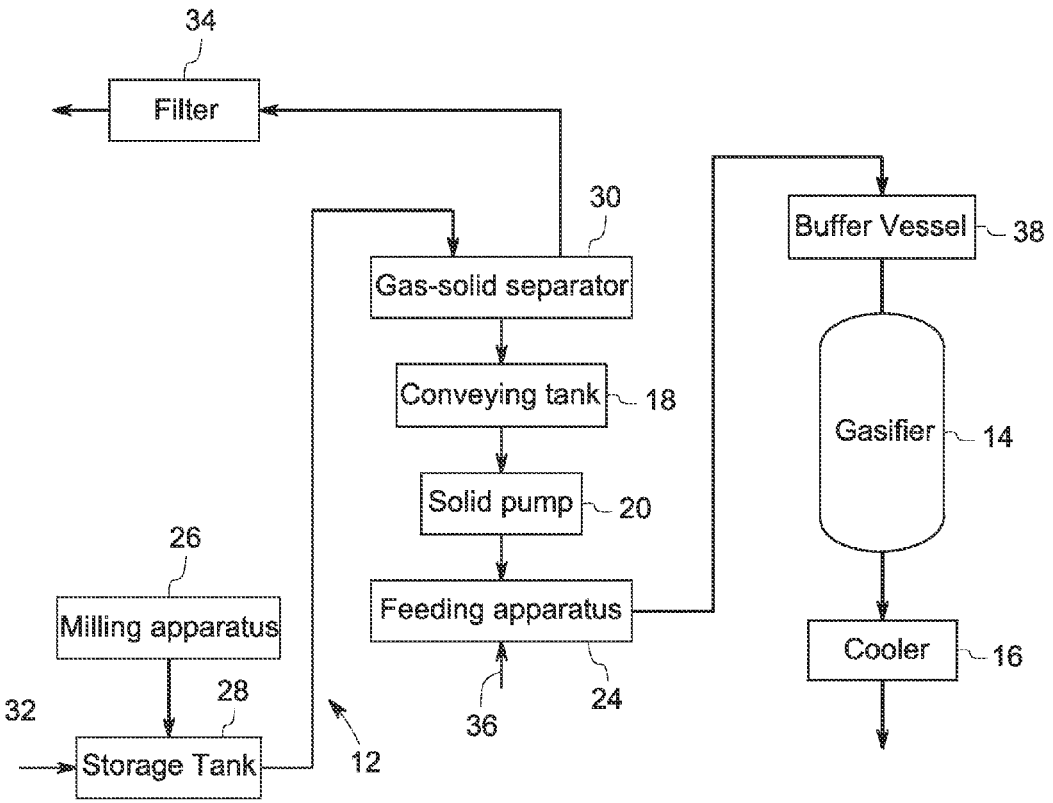

In some applications, in order to ensure the gasifier to operate stably, a buffer vessel 38, as illustrated in FIG. 4, may be disposed between the solid pump 20 and the gasifier 14 for receiving and introducing the solid powder 100 from the solid pump 20 into the gasifier 14. The arrangement in FIG. 4 is similar to the arrangement in FIG. 3. The two arrangements in FIGS. 3 and 4 differ in that the conveyance unit 12 further comprises the buffer vessel 38 located between the solid pump 20 and the gasifier 14. In the illustrated example, the buffer vessel 38 is located above the gasifier 14.

It should be noted that the arrangement in FIG. 4 is merely illustrative. In certain applications, the buffer vessel 38 may not be located above the gasifier 14. In other examples, the solid pump 20 may be disposed above the buffer vessel 38, as illustrated in FIG. 5.

Figure 5:
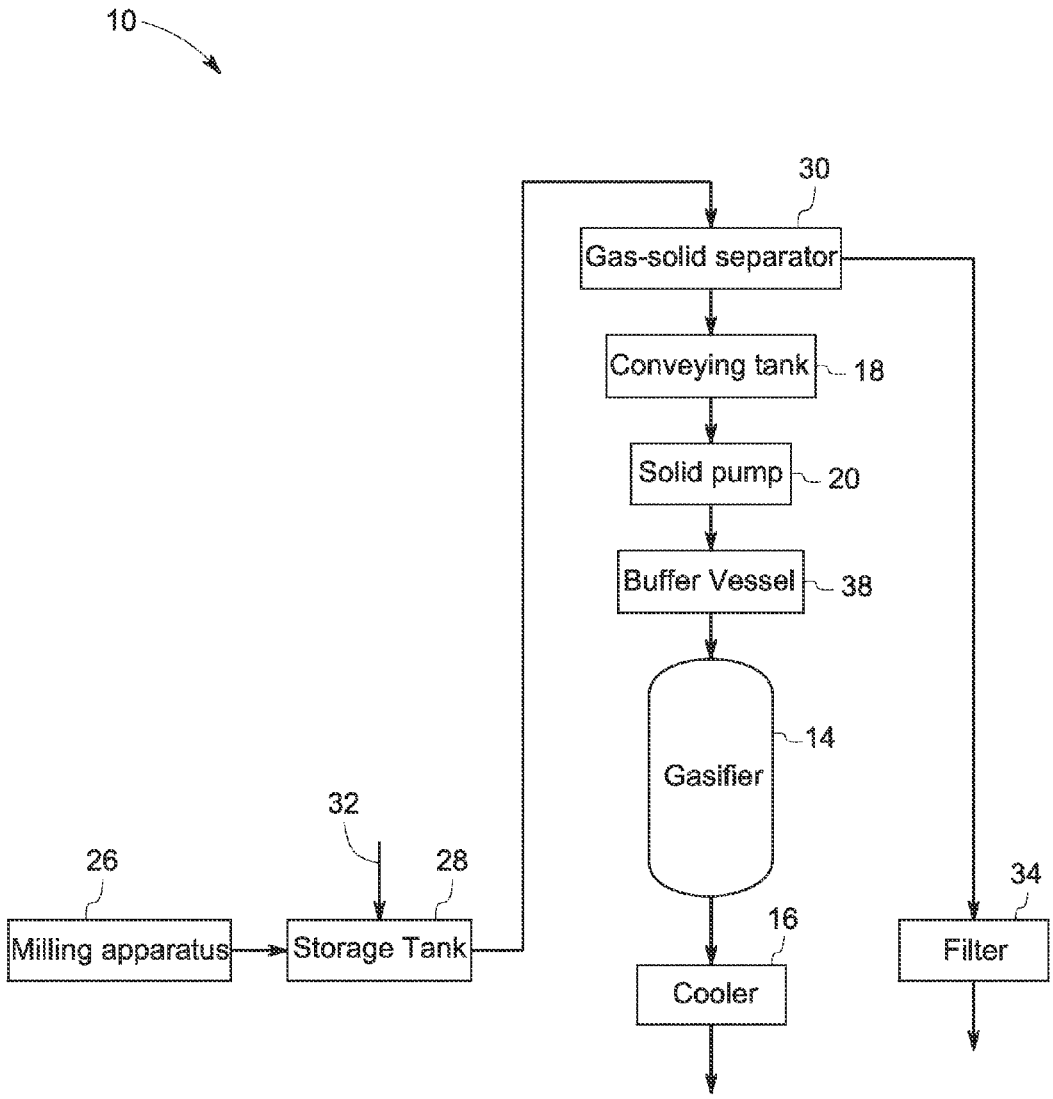

The arrangement in FIG. 5 is similar to the arrangement in FIG. 4. The two arrangements in FIGS. 4-5 differ in that in FIG. 5, the solid pump 20 may be disposed above the buffer vessel 38 and the feeding apparatus 24 is not employed. In some examples, the feeding apparatus 24 may also be disposed between the solid pump and the buffer vessel.

Figure 6:
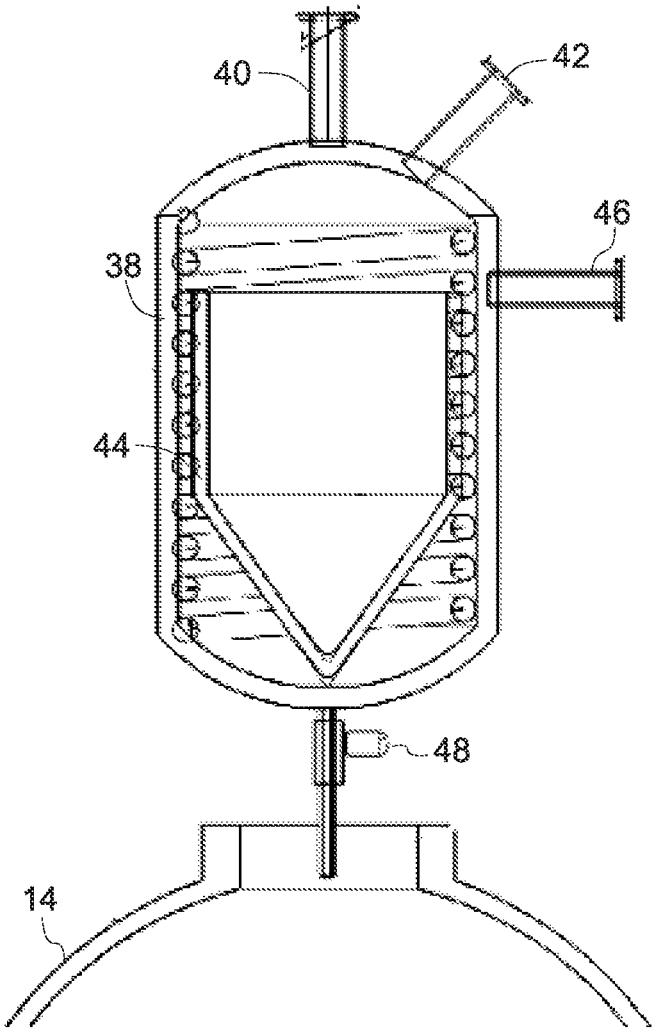

FIG. 6 illustrates a schematic diagram of an arrangement of the buffer vessel 38 and the gasifier 14 shown in FIGS. 4-5. As illustrated in FIG. 6, the buffer vessel 38 has a cylindrical shape with substantially conical or convex upper and lower ends (not labeled). In other examples, the buffer vessel may have other shapes suitable for receiving and conveying the solid powder.

For the illustrated example in FIG. 6, the buffer vessel 38 comprises an inlet 40 in fluid communication with the solid pump 20. A valve (not shown) may be disposed between the solid pump 20 and the buffer vessel 38. A gas inlet 42 is also defined on the upper end of the buffer vessel 38 and is configured to introduce a gas (not shown) into the buffer vessel 38 to increase the pressure in the buffer vessel to a desired level and carry the solid powder 100 in the buffer vessel 38 into the gasifier 14. The flow rate of the gas through the gas inlet 42 may be adjusted by a valve (not shown) according to the feeding rate of the solid powder and the pressure drop between the buffer vessel 38 and the gasifier 14. In some applications, an inert gas or syngas can be introduced into the buffer vessel 38. In one example, the pressure in the buffer vessel 38 may be about 1500 psi.

In addition, in order to avoid coal pyrolysis in the buffer vessel 38, a cooling element 44 such as a water wall is disposed within of the buffer vessel 38 to cool down the temperature in the buffer vessel 38. In certain applications, the buffer vessel 38 further comprises a backup coal inlet 46 in the event of the pump failure, which may provide the solid powder 100 for a period of time to keep the operation in the gasifier 14 stable. In some examples, a solid flow meter 48 may be disposed between the buffer vessel 38 and the gasifier 14 to monitor the flow of the solid power 100 into the gasifier 14.

Thus, for the arrangements in FIGS. 4-5, during operation, the solid powder 100 is pressurized by the solid pump 20, and is then fed into the buffer vessel 38. For the arrangement in FIG. 4, after being pressurized out of the solid pump 20 and before entering into the buffer vessel 38, the solid powder 100 passes though the feeding apparatus 24.

Figure 7:
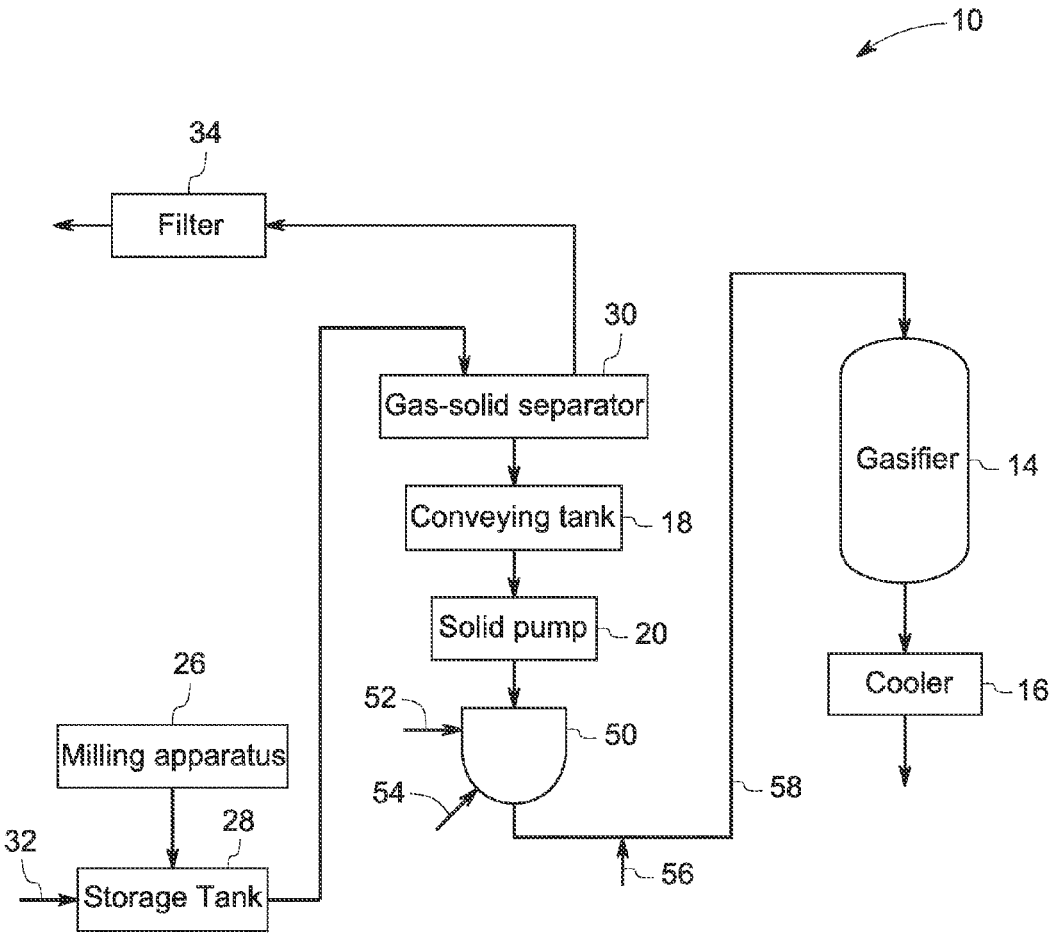

FIG. 7 illustrates a schematic diagram of the gasification system 10 in accordance with yet another embodiment of the invention. As illustrated in FIG. 7, the arrangement in FIG. 7 is similar to the arrangement in FIG. 3. The two arrangements in FIGS. 7 and 3 differ in that the arrangement in FIG. 7 employs a buffer hopper 50 disposed between the solid pump 20 and the gasifier 14 instead of the feeding apparatus in FIG. 3. As illustrated in FIG. 7, the buffer hopper 50 is located below the solid pump 20 and the gasifier 14.

During operation, the solid powder 100 is pressurized into the buffer hopper 50. A carrier gas 52 is introduced into the buffer hopper 50 to increase the pressure therein so as to generate a pressure difference between the buffer hopper 50 and the gasifier 14 and form a gas-solid mixture. Non-limiting examples of the carrier gas 52 include carbon dioxide, inert gas such as nitrogen, syngas or other suitable gases. In some examples, the pressure in the buffer hopper 50 may be higher than the pressure in the gasifier. In one example, the pressure in the buffer hopper 50 is about 3 Mpa.

Subsequently, the gas-solid mixture is conveyed into the gasifier 14 from the buffer hopper 50 through the pipeline 58 connecting the gasifier 14 and the buffer hopper 50. In certain applications, a fluidizing gas 54 may be introduced into the buffer hopper 50 from a lower portion (not labeled) of the buffer hopper 50 to avoid agglomeration of the solid powder 100 in the buffer hopper 50. Further, a supplementary gas 56 may be introduced into the pipeline 58 to adjust the concentration of the solid powder in the pipeline 58 for facilitating the pneumatic conveyance of the solid powder into the gasifier. In some applications, the fluidizing gas 54 and/or the supplementary gas 56 may comprise similar gas as the carrier gas 52.

It should be noted that the arrangement in FIG. 7 is merely illustrative. In the illustrated example, the solid powder 100 is conveyed from the lower portion of the buffer hopper 50 into the gasifier 14. In other examples, the solid powder 100 may be conveyed from an upper portion (not labeled) of the buffer hopper 50 into the gasifier 14. In some examples, one or more of the buffer vessel 38 and the feeding apparatus 24 may also be disposed between the buffer hopper 50 and the gasifier 14. The buffer hopper 50 may be disposed above the gasifier 14. Additionally, for the arrangements in FIGS. 1 and 3-7, although the inlet of the gasifier is disposed on the upper portion thereof, the inlet of the gasifier may be defined at a lower portion thereof.

In embodiment of the invention, the gasification system employs one or more solid pumps for conveyance of the solid powder into the gasifier for gasification. Due to the existence of the one or more solid pumps, the flow of the solid powder may be more uniform and stable. In addition, when the solid powder comprises coal having higher moisture content, less energy may be consumed to dry the solid powder for conveyance into the gasifiers through the solid pump. In other examples, one or more of the feeding apparatus, the buffer vessel and the buffer hopper are also employed to ensure the gasifier to operate stably. The positions of the solid pump, the feeding apparatus, the buffer hopper and the buffer vessel may be varied based on different applications. In certain applications, the one or more solid pumps may also be used to convey stuff into a device such as a blast furnace for processing.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the spirit and scope of the disclosure as defined by the following claims.

What is claimed is:

1. A system for gasification of a solid powder, comprising:

one or more conveying tanks configured to receive a solid powder;

one or more solid pumps disposed downstream of and in communication with the one or more respective conveying tanks; and a gasifier disposed downstream of and in fluid communication with the one or more solid pumps;

the system further comprising a buffer vessel comprising a cooling element, the buffer vessel disposed between and in fluid communication with the one or more solid pumps and the gasifier.

2. The system of claim 1, wherein the one or more solid pumps are disposed below the one or more respective conveying tanks.

3. The system of claim 1, further comprising a feeding apparatus disposed between and in fluid communication with the one or more solid pumps and the gasifier.

4. The system of claim 3, wherein one or more of the one or more solid pumps and the feeding apparatus are disposed below the gasifier.

5. The system of claim 1, wherein the buffer vessel is located above the gasifier.

6. The system of claim 1, further comprising a buffer hopper disposed below and in fluid communication with the one or more solid pumps and the gasifier.

7. The system of claim 1, wherein the one or more solid pumps are located above the gasifier.

8. The system of claim 1, further comprising a milling apparatus, one or more gas-solid separators configured to convey the solid powder to the one or more respective conveying tanks and a storage tank in fluid communication with the milling apparatus and the one or more gas-solid separators.

9. A conveyance unit for conveying a solid powder for gasification, comprising:

one or more gas-solid separators configured to convey solid powder into one or more conveying tanks;

one or more conveying tanks configured to receive the solid powder from the one or more gas-solid separators;

one or more solid pumps disposed downstream of the one or more respective conveying tanks and configured to pressurize and convey the solid powder from the one or more respective conveying tanks for gasification;

a buffer hopper comprising a pressurizing gas inlet, the buffer hopper disposed below a gasifier and in fluid communication with the one or more solid pumps; and a buffer vessel comprising a cooling element disposed downstream of the buffer hopper and in fluid communication with the buffer hopper and the gasifier.

10. The conveyance unit of claim 9, further comprising a feeding apparatus disposed downstream of and in fluid communication with the one or more solid pumps.

11. A method for gasification of a solid powder, comprising:

introducing a solid powder into one or more conveying tanks;

introducing the solid powder from the one or more conveying tanks into one or more respective solid pumps disposed downstream of the one or more respective conveying tanks;

providing a buffer hopper comprising a pressurizing gas inlet to receive and convey the solid powder from the one or more solid pumps, wherein the buffer hopper is disposed below a gasifier;

providing a buffer vessel comprising a cooling element to receive and convey the solid powder from the buffer hopper into the gasifier, wherein the buffer vessel is disposed above the gasifier; and pressurizing and conveying the solid powder into the gasifier.

12. A method of claim 11, wherein the one or more solid pumps are located above the gasifier.

13. A method of claim 11, further comprising providing a feeding apparatus to convey the solid powder from the one or more solid pumps into the gasifier.

14. A method of claim 11, wherein the one or more solid pumps are located below the gasifier.

* * * * *